US008434702B2

(12) United States Patent
Mori et al.

(10) Patent No.: US 8,434,702 B2
(45) Date of Patent: May 7, 2013

(54) ELECTROSTATIC COATING SYSTEM

(75) Inventors: Takanobu Mori, Aichi (JP); Kengo Honma, Aichi (JP); Tooru Yokota, Aichi (JP); Kimiyoshi Nagai, Kanagawa (JP)

(73) Assignees: Toyota Jidosha Kabushiki Kaisha, Aichi (JP); Ransburg Industrial Finishing K.K., Kanagawa (JP)

( * ) Notice: Subject to any disclaimer, the term of this patent is extended or adjusted under 35 U.S.C. 154(b) by 721 days.

(21) Appl. No.: 12/025,259

(22) Filed: Feb. 4, 2008

(65) Prior Publication Data

US 2009/0108109 A1 Apr. 30, 2009

(51) Int. Cl.
*B05B 5/00* (2006.01)

(52) U.S. Cl.
USPC ..... 239/690; 239/700; 239/708; 239/302; 901/43

(58) Field of Classification Search ..... 239/690–708, 239/302; 901/43
See application file for complete search history.

(56) References Cited

U.S. PATENT DOCUMENTS

| | | | | |
|---|---|---|---|---|
| 4,997,130 | A * | 3/1991 | Weinstein | 239/222 |
| 5,293,911 | A * | 3/1994 | Akeel | 141/346 |
| 6,612,345 | B1 * | 9/2003 | Hosoda et al. | 141/20.5 |
| 6,742,722 | B2 * | 6/2004 | Hosoda et al. | 239/305 |
| 7,617,997 | B2 * | 11/2009 | Nagai | 239/690 |
| 2005/0194474 | A1 * | 9/2005 | Sakakibara et al. | 239/690 |

FOREIGN PATENT DOCUMENTS

| | | |
|---|---|---|
| JP | 09-262510 | 10/1997 |
| JP | 10-109054 | 4/1998 |
| JP | 2002-186884 | 7/2002 |

* cited by examiner

*Primary Examiner* — Steven J Ganey
(74) *Attorney, Agent, or Firm* — Kilyk & Bowersox, P.L.L.C.

(57) ABSTRACT

An electrostatic coating system includes a coating robot (1) and an electrostatic atomizer (6) attached to a polyarticular wrist portion (5) of the robot (1). The atomizer (6) includes an end plate (45), metallic connector (50) fixed to the end plate (45) in electric conduction, high voltage generator (20) and bell head (18). Electric power is supplied to the high voltage generator (20) through the connector (50). Wires (53) are connected to the connector (50) to take out high voltage leak caused by contamination like a deposition of paint on outer surfaces of the atomizer (6) through the wires 53 to control the high voltage generator (20) to lower the value of the high voltage applied to the bell head (18) of high voltage leak detected through the wires (53) is larger than a predetermined threshold value.

8 Claims, 8 Drawing Sheets

ELECTROSTATIC COATING SYSTEM

FIELD OF THE INVENTION

The present invention generally relates to an electrostatic coating system, and more particularly, to an electrostatic coating system including an electrostatic atomizer attached to an arm of a coating robot.

BACKGROUND OF THE INVENTION

Electrostatic atomizers are devices for applying atomized and electrically charged paint onto work pieces due to electrostatic attraction under an electrostatic field generated by application of a high voltage. Because they use such a high voltage, leakage of the high voltage is one of important issues of electrostatic atomizers and electrostatic coating systems including such electrostatic atomizers.

In Japanese Patent Laid-open Publication No. JP H10 (1998)-109054, it is pointed out that a deposition of paint on the outer surface of an electrostatic atomizer may act to bring about a high voltage leak or, when fragments of the deposit of paint from the outer surface of the atomizer happen to adhere onto a work, they degrade the coating quality of the work. As a countermeasure with this problem, this publication proposes to detect a leak current by locating a grounded electrode at a position apart from the front end of the electrostatic atomizer, that is, at a position apart from a high voltage application electrode (like a bell head, for example) for electrostatically charging the paint particles.

The above proposal is effective to alleviate the problem caused by deposition of paint onto outer surfaces of electrostatic atomizers. Most electrostatic atomizers have the characteristics that, if the atomizer has been contaminated, a leak current exhibits a preliminary rise before the contamination heavily increases. Therefore, the preliminary rise of the leak current may be detected to use it as a factor for a countermeasure against leakage of current such as issuing an alarm, for example.

In Japanese Patent Laid-open Publication No. JP 2002-186884, it is proposed to solve the problem caused by a deposition of paint on outer surfaces of an electrostatic atomizer by integrating the magnitude of a current or voltage in a high voltage application path for supplying a high voltage to a high voltage application electrode to issue an alarm to call operator's attention when the integrated value exceeds a predetermined threshold.

According to Japanese Patent Laid-open Publication No. JP H10-109054, the grounded electrode is provided on an outer surface of an electrostatic atomizer as explained above. This publication further proposes the use of a ring-shaped grounded electrode provided directly on an electrically insulative outer housing of the electrostatic atomizer or in a location radially outwardly apart from the outer housing.

However, the additional use of the grounded electrode raises the cost, and also requires a change of design of the outer housing of the electrostatic atomizer.

SUMMARY OF THE INVENTION

Under the situation, it is desirable to overcome the above-mentioned drawbacks of the existing electrostatic atomizers by providing an electrostatic atomizer capable of detecting a high voltage leak caused by contamination of the outer surface of the electrostatic atomizer without the need of using any additional grounded electrode.

According to an embodiment of the present invention, there is provided an electrostatic coating system including an electrostatic atomizer which has a high voltage application electrode provided at a distal end thereof to be supplied with a high voltage, and generates an electrostatic field between the high voltage application electrode and a work to electrically charge a paint and deposit the electrically charged paint onto the work due to electrical absorption, comprising:

an electrically conductive end plate disposed at a rear end of the electrostatic atomizer apart from the high voltage application electrode thereof, wherein high voltage leak caused by contamination of outer surfaces of the electrostatic atomizer is detected via the end plate.

Most of existing electrostatic atomizers already use end plates. Therefore, this concept of detecting a high voltage leak caused by contamination of the outer surface of the electrostatic atomizer by using the end plate does not require any additional ring-shaped grounded electrode that was required in the Japanese Patent Laid-open Publication No. JP H10-109054.

In a typical application of the present invention, electric power is supplied to the electrostatic atomizer through an electrically conductive connector fixed to the end plate and a high voltage leak caused by the contamination of the outer surface of the atomizer is detected via a wire connected to the conductive connector. For power supply to the atomizer, in general, an insulated cable sheathed with an insulative film is used. Therefore, the use of the wire connected to the connector for the cable to detect a leak current is advantageous because the detected leak current is unlikely to be influenced by any leak current inside the electrostatic atomizer.

The electrostatic atomizer using the end plate is typically used in combination with a coating robot. In addition, in case a water-borne paint or an electrically conductive paint such as a metallic paint is used, the paint and the paint paths must be electrically insulated from the atomizer and the painting robot. Electrostatic atomizers using a removable paint cartridge meet this requirement.

According to an embodiment of the present invention, there is provided on the outer margin of the end plate an electrically conductive extension ring that extends the end plate toward the front end of the electrostatic atomizer. By putting the conductive extension ring in abutment with the outer margin of the end plate, a high voltage leak caused by contamination of the outer surface of the atomizer can be led preferentially to the end plate via the conductive extension ring. In other words, the high voltage leak caused by the contamination of the atomizer outer surface can be substantially prevented from flowing toward the arm of the coating robot.

The electrostatic atomizer is supplied with various fluids, including liquids like a thinner and gases like shaping air. Electrostatic coating systems including a coating robot are configured to supply the atomizer with these fluids through a plurality of tubes passing through the robot arm, and for this purpose, conventional atomizers have couplings fixed to the end plate to make connection of individual tubes. According to an embodiment of the present invention, which is an electrostatic coating system including a coating robot, couplings to connect the plurality of tubes inside the robot arm to counterpart tubes inside the atomizer are fixed to the end plate via an electrically insulative material, and individual wires are connected to corresponding couplings to detect any voltage leak inside the electrostatic atomizer through the individual wires.

According to another embodiment of the present invention, a secondary plate made of an electrically insulative material is provided adjacent to the end plate. The couplings of the tubes inside the electrostatic atomizer are fixed to the secondary plate. Each of the couplings has connected thereto the wire via which a voltage leak occurring inside the atomizer is detected.

In this configuration, it is possible to detect a high voltage leak caused by contamination of the outer surface of the electrostatic atomizer as well as a high voltage leak inside the electrostatic atomizer and to control the value of a high voltage to be applied to the electrostatic atomizer, based on the high voltage leak occurring inside and outside the electrostatic atomizer. In addition, it is possible to locate a high voltage leak detected via each of the tubes and find out in which one of the internal tubes the outstanding high voltage leak has occurred. Therefore, by combining indication on an monitor that contamination of the outer surface of the electrostatic atomizer is the cause of the high voltage leak, indication that the shaping-air tube inside the electrostatic atomizer is the cause of the high voltage leak and/or indication that the cleaning thinner tube inside the electrostatic atomizer is the cause of the high voltage leak, the coating operator can quickly cope with the situation by appropriate repair.

The electrostatic coating system according to the present invention is used to coat relatively expensive works such as vehicle bodies. Interruption of the coating operation every time upon occurrence of a high voltage leak invites a large economic loss. Therefore, it is desirable for the coating system to continue the coating operation without interruption even if a high voltage leak occurs. For this purpose, the electrostatic coating system preferably has a controller that can lower the value of a high voltage supplied to the high voltage application electrode when a high voltage leak is caused by contamination of the outer surface of the electrostatic atomizer. With this high voltage controller, it is possible to prevent the high voltage leak from getting excessively large by lowering the value of the high voltage supplied to the high voltage application electrode, which is the source of the high voltage leak, thereby permitting the coating operation to be continued.

The foregoing and other features, aspects and advantages of the present invention will be come apparent from the following detailed description of the present invention when taken in conjunction with the accompanying drawings.

DETAILED DESCRIPTION OF THE INVENTION

Some preferred embodiments of the present invention will be described below in detail with reference to the accompanying drawings.

Figure 1:
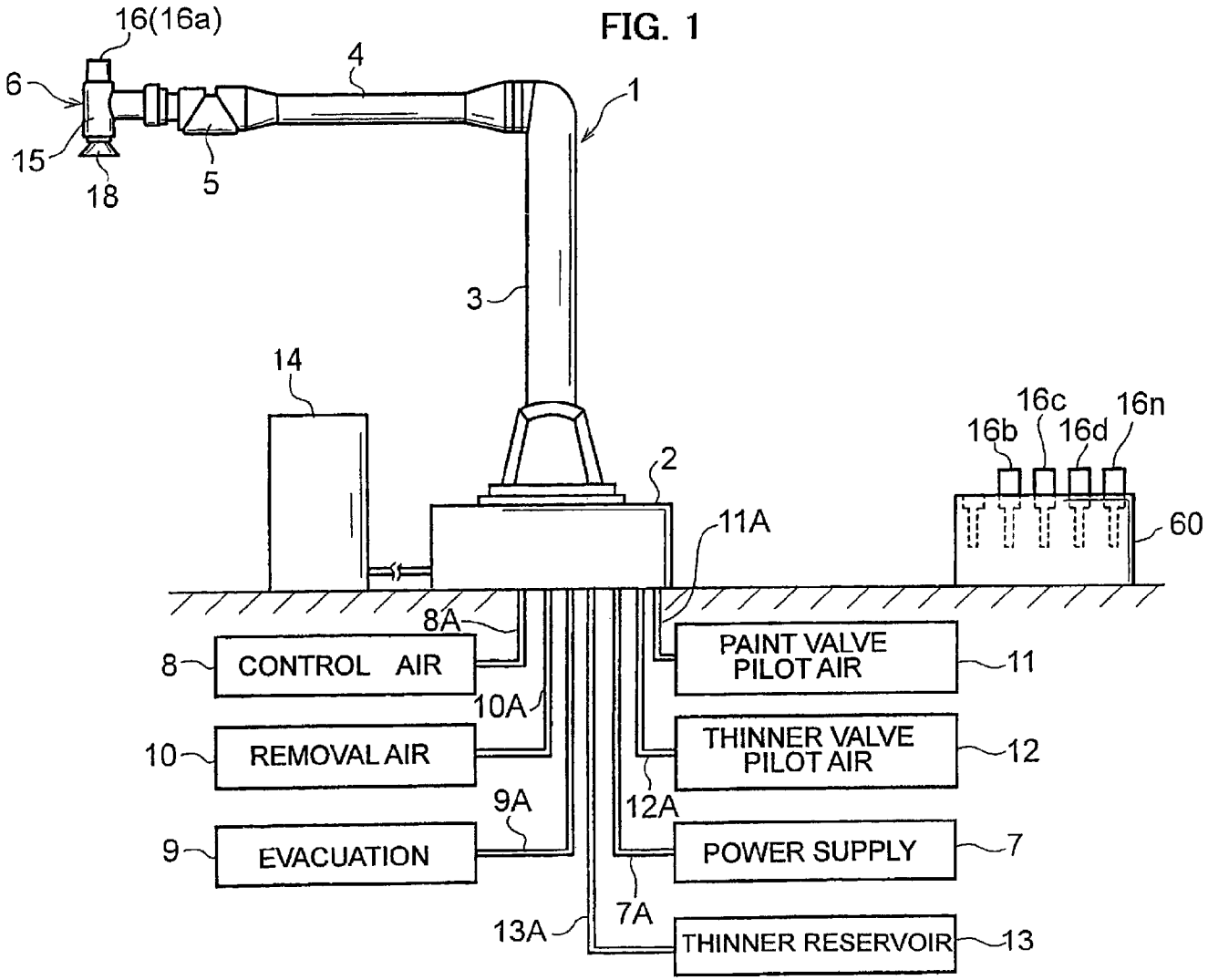
FIG. 1 is a schematic general view of an electrostatic coating system including a coating robot and an electrostatic atomizer according to a first embodiment of the present invention.

FIG. 1 schematically illustrates an electrostatic coating system including a coating robot 1. As shown, the coating robot 1 includes a base 2, vertical arm 3 extending upward from the base 2, horizontal arm 4 extending horizontally from the upper end of the vertical arm 3 and polyarticular wrist portion 5. The system further includes an electrostatic atomizer 6 attached to the polyarticular wrist portion 5. The vertical arm 3 of the coating robot 1 can rotate about its axis and can swing relative to the base 2. The horizontal arm 4 of the coating robot 1 can swing in any direction relative to the vertical arm 3.

The coating system further includes a power unit 7, control air source 8, negative pressure source or vacuum source 9, removing-air source 10, pilot air source 11 for controlling a paint valve, pilot air source 12 for controlling a thinner valve, thinner reservoir 13, etc. The power unit 7 is connected to the coating robot 1 by a power cable 7A. The control air source 8, negative pressure source 9, etc. are connected to the coating robot 1 by tubes or hoses 8A to 13A. The electrostatic atomizer 6 is supplied with an electric power from the power unit 7 and compressed air from the control air source 8, respectively, through cables and tubes extending in and through the vertical and horizontal arms 3 and 4 of the robot 1, and exchanges signals with a control panel 14.

Figure 2:
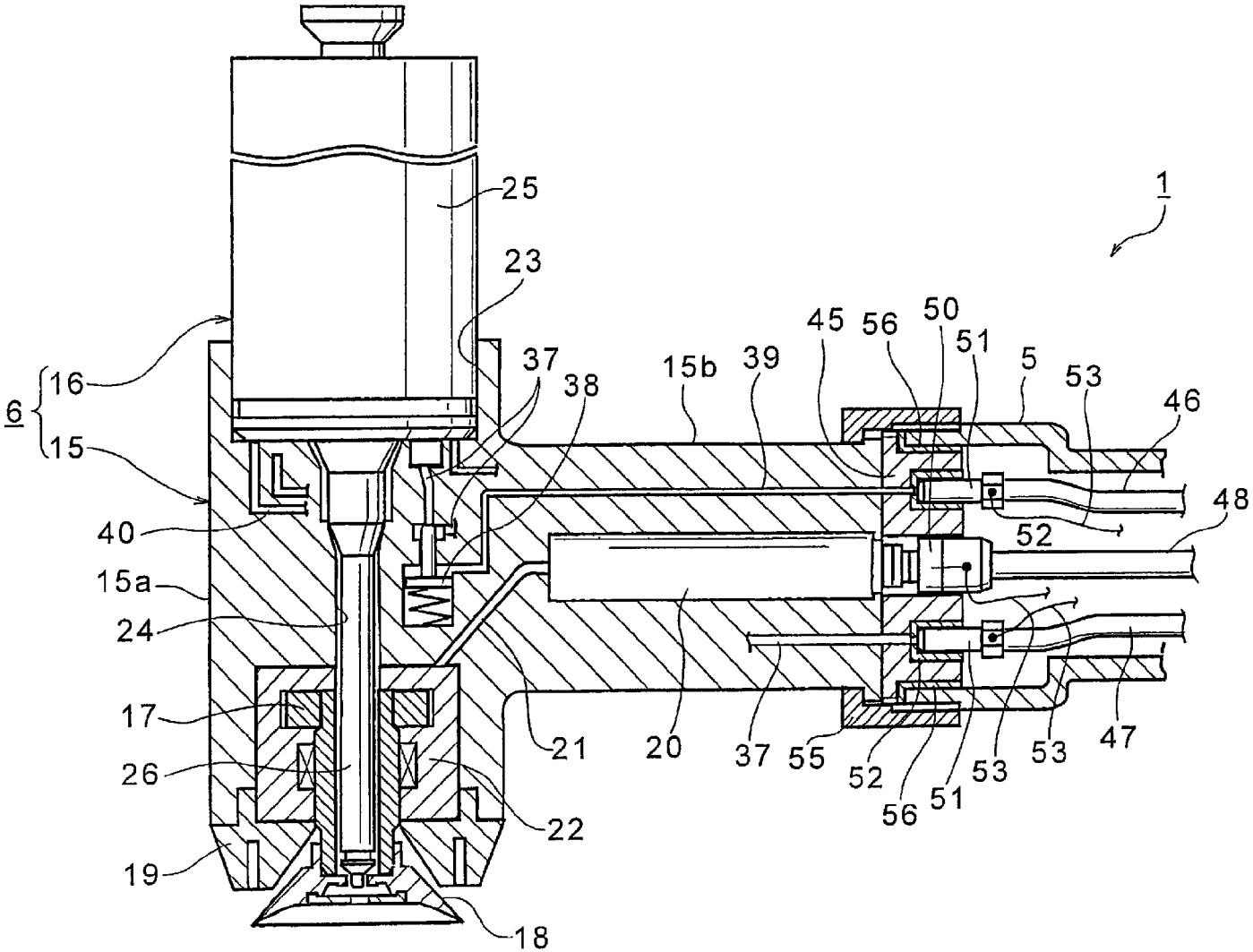
FIG. 2 is a cross-sectional enlarged view of the atomizer and a wrist portion of the coating robot, to which the atomizer is coupled, in the electrostatic coating system.

The atomizer 6 comprises an atomizer main body 15 and a paint cartridge 16 removably mounted in the atomizer main body 15. As shown in FIG. 2, the atomizer main body 15 contains an air motor 17 having a bell-shaped rotary head (bell head) 18 attached thereto. The atomizer main body 15 also includes a shaping air outlet 19. As in the conventional electrostatic atomizer, the bell head 18 atomizes paint and the shaping air outlet 19 controls the spray pattern (coating pattern) of paint.

The atomizer main body 15 made of an electrically insulative resin is generally T-shaped as a whole. More specifically, the atomizer main body 15 includes a paint supply part 15*a* containing the air motor 17 etc. and a high voltage generation part 15*b* extending perpendicularly to the paint supply part 15*a*. The high voltage generation part 15*b* has a high voltage generator 20 inside. A high voltage generated by the high voltage generator 20 is supplied to a metallic casing 22 of the air motor 17 through an internal high-voltage cable 21, and further to the bell head 18 that serves as a high voltage application electrode through the metallic casing 22.

The paint supply part 15*a* of the atomizer main body 15 has formed in the rear end face thereof a recess 23 in which the paint cartridge 16 is seated. The atomizer main body 15 further has formed therein a feed tube insertion hole 24 extending straight from the recess 23 toward the bell head 18.

As shown, the paint cartridge 16 includes a paint tank 25 and a feed tube 26 extending straight from the front end face of the paint tank 25. For loading the paint cartridge 16 into the recess 23 in the atomizer main body 15, the feed tube 26 is inserted into the feed tube insertion hole 24. Once the paint cartridge 16 is attached to the atomizer main body 15, the end of the feed tube 26 takes its position at the center of the bell head 18. In this condition, paint in the paint tank 25 is supplied to the bell head 18 through the feed tube 26.

Figure 3:
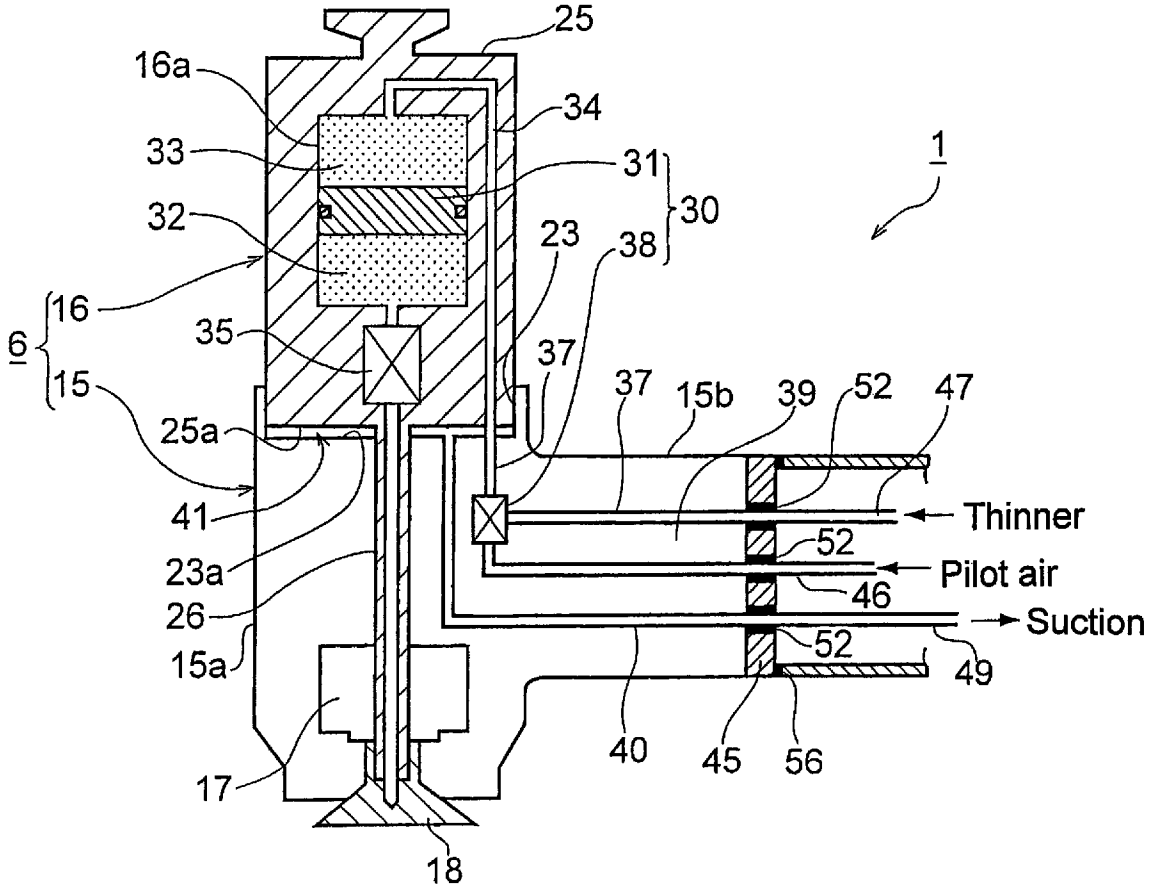
FIG. 3 is a diagram for explaining tubes or passages, related to a paint cartridge, inside the atomizer.

The paint cartridge 16 has a paint dispenser 30 as shown in FIG. 3. The paint dispenser 30 includes a piston 31 fitted in a cylindrical vessel 16*a* in the paint cartridge 16. As the piston 31 moves, the paint in the vessel 16*a* is pushed out toward the bell head 18 through the feed tube 26.

More specifically, the vessel 16*a* in the paint cartridge 16 is partitioned by the piston 31 into a paint chamber 32 and drive chamber 33. The paint chamber 32 contains a liquid paint. The drive chamber 33 is supplied with a push-out thinner through a thinner supply passage 34 formed in the paint cartridge 16. The push-out thinner supplied to the drive chamber 33 moves the piston 31 downward as viewed in FIG. 3. Thus, the paint in the paint chamber 32 is discharged through a check valve 35 and feed tube 26. The check valve 35 allows the paint to discharge from the paint chamber 32 through the feed tube 26 but prohibits its back flow through the feed tube 26 toward the paint chamber 32. To minimize the possibility of a high voltage through the thinner used as a push-out liquid, the thinner is preferably of a high insulating performance or a high electric resistance.

The thinner supply passage 34 formed in the paint cartridge 16 is supplied with the push-out thinner through a thinner supply tube 37 provided inside the atomizer main body 15. The thinner supply tube 37 has a control valve (thinner valve) 38 inside. The thinner valve 38 is controlled by pilot air to thereby control the amount of the push-out thinner to be supplied to the paint cartridge 16. The reference numeral 39 in FIG. 3 indicates a pilot air tube disposed inside the atomizer main body 15, through which the pilot air is supplied from the pilot air source 12, shown in FIG. 1, to the thinner valve 38. Supply of the pilot air to the thinner valve 38 is controlled by a control unit not shown.

The atomizer main body 15 has a suction tube 40 opening at the bottom 23*a* of the recess 23 in which the paint cartridge 16 is received. The suction tube 40 is connected to the negative pressure source or vacuum source 9 shown in FIG. 1. After the paint cartridge 16 is attached to the atomizer main body 15 and secured with a locking member (not shown), a clearance 41 between the bottom 23*a* of the recess 23 of the atomizer main body 15 and the front face 25*a* of the paint tank 25 is evacuated through the suction tube 40.

The electrostatic atomizer 6 has an electrically conductive end plate (typically made of stainless steel) 45 which defines the end face of the high voltage generation part 15*b*, and it is fastened to the wrist portion 5 of the coating robot 1, interposing the end plate 45 between them. As shown in FIG. 2, the end plate 45 has connection holes for connection of air, thinner and electric passages provided inside the atomizer main body 15. FIG. 2 shows the end plate 45 as being in connection only with a pilot air supply tube 46 for supply of the pilot air for control of the thinner valve to the atomizer main body 15, thinner supply tube 47 for connecting the counterpart push-out thinner supply tube 37 in the atomizer main body 15 to the thinner reservoir 13 and an electric cable 48 for supplying an electric power from the power unit 7 to the high voltage generator 20 for simplicity of illustration. Actually, however, the end plate 45 receives a tube 49 for connecting the suction tube 40 in the atomizer main body 15 to the negative pressure source 9 (shown in FIG. 3), and other various tubes for the control air and pilot air to be supplied to the atomizer 6, air-bearing air for the air motor 17, air to be supplied to a turbine in the air motor 17, brake air for the air motor 17, removing-air for the paint cartridge 16, etc. for coupling atomizer-side counterparts and robot-side counterparts.

The end plate 45 is made of an electrically conductive material such as stainless steel. Fixed to the end plate 45 are metallic couplings 51 for the liquid and air supply systems entirely or partly via electrically insulating elements 52 excluding the metallic connector 50 for coupling of the electric cable 48. Wires 53 are connected to the connector 50 and couplings 51, respectively. Opposite ends of the wires 53 are connected to the control panel 14 through inside the horizontal and vertical arms 3 and 4.

The atomizer 6 including the end plate 45 is coupled to the wrist portion 5 of the coating robot 1 with a cover nut 55 formed from an electrically insulative plastic resin (see FIG. 2). The outer housings of the wrist portion 5 and horizontal and vertical arms 4 and 3 are made of stainless steel, and an electrically insulative material 56 is interposed between the outer housing of the wrist portion 5 and the first plate 45.

Next explained is a procedure for changing the color of paint from color a to color b. In a coating booth, a cartridge holder 60 is placed near the coating robot 1. The cartridge holder 60 can hold paint cartridges 16*a*, 16*b*, . . . , 16*n* containing paints of different colors. After a work is coated with a paint of color a, the vertical and horizontal arms 3 and 4, etc. of the coating robot 1 are moved, carrying the paint cartridge 16*a* containing a paint of color a still held on the atomizer main body 15, to bring the atomizer 6 to a bell head cleaning device (not shown) located near the cartridge holder 60.

After that, the bell head cleaning device sprays a cleansing thinner against the atomizer 6 (and the bell head 18) in position to flush away a deposition of the paint of color a on the bell head 18 and its peripheral members. After the bell head 18 is cleaned, the system proceeds with replacement of the paint cartridge 16 from one to another.

For the replacement of the paint cartridge 16, the air motor 17 is stopped to rotate. At the same time, supply of shaping air is interrupted, and evacuation by the negative pressure source 9, which has heretofore held the paint cartridge 16*a* of color a firmly in the atomizer main body 15, is stopped as well. After that, air is supplied from the removing-air source 10 to the clearance 41 between the bottom 23*a* of the recess 23 and front face 25*a* of the paint tank 25 through an air hose 10A to unload the paint cartridge 16*a*.

Then, the paint cartridge 16*a* is pulled out of the atomizer main body 15 and returned to the cartridge holder 60. Thereafter, the paint cartridge 16*b* containing a paint of color b is taken out of the cartridge holder 60 and attached to the atomizer main body 15. When the feed tube 26 of the paint cartridge 16*b* is inserted into the feed tube insertion hole 24 in the atomizer main body 15, the clearance 41 between the recess 23 of the atomizer main body 15 and front face 25*a* of the paint tank 25 is allowed to communicate with the negative pressure source 9, and air in the clearance 41 is evacuated.

After the paint cartridge 16*b* containing the paint of color b is thus fixed to the atomizer main body 15, the air motor 17 is driven by air supplied from the control air source 8 to rotate the bell head 18 while activating the shaping air source 19 to supply a jet of shaping air. Thus, the atomizer 6 is ready for coating. To start coating with the paint of color b, electric power is supplied from the power unit 7 to the high voltage generator 20 to apply a high voltage to the bell head 18. On the other hand, the push-out thinner is dispensed to the drive chamber 33 of the paint cartridge 16*b*. Thus, the paint of color b in the paint chamber 32 is supplied to the bell head 18 through the feed tube 26, and it is atomized and electrostatically charged by the bell head 18 rotating at a high speed.

Figure 4:
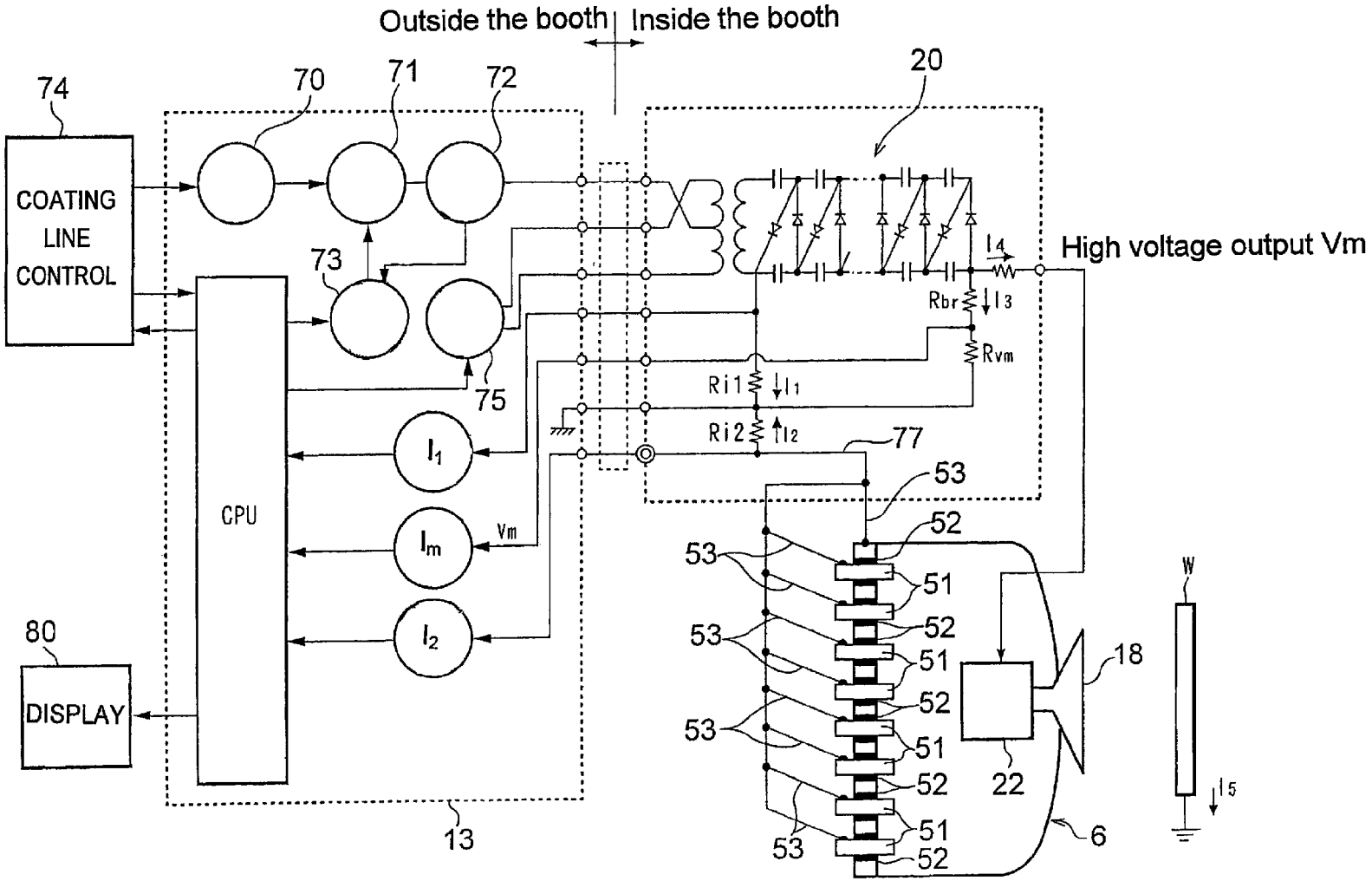
FIG. 4 is a general schematic diagram of a high voltage control system adopted in the electrostatic coating system according to the first embodiment of the present invention.

FIG. 4 is a general diagram of an electrostatic coating system. The control panel 14 has an AC-DC converter 70 that changes an AC power supplied from a commercial AC source to a voltage for supply to the atomizer 6. A low voltage output from the AC-DC converter 70 is adjusted to a required voltage in a switching drive 71, and then supplied to the high voltage generator 20 in the atomizer 6. The power supplied to the high voltage generator 20 is feedback-controlled by a sensor 72 (for voltage and current values) and a high voltage control circuit (HV control circuit) 73.

Reference numeral 74 in FIG. 4 denotes a coating line controller 74. The coating line controller 74 supplies the HV control circuit 73 with a commanded high voltage value VT corresponding to the required color (paint to be used), etc. of a vehicle body transported along a coating line. The HV control circuit 73 controls the switching drive 71 such that the high voltage applied to the bell head 18 becomes the high voltage value VT specified by the command.

The high voltage generator 20 in the atomizer 6 typically comprises a Cockcroft-Walton circuit. It receives outputs from the switching drive 71 and an oscillating circuit 75 in the control panel 14 to generate a DC high voltage. A total current $I_1$ supplied to the bell head 18 from the high voltage generator 20 and a current $I_m$ equivalent to an output high voltage value $V_m$, that is, a current equivalent to a high voltage applied to the bell head 18, are supplied to the control panel 14 through the LV (low voltage) cable.

All leak currents detectable via the end plate 45 of the atomizer 6 and the wires 53 connected to the couplings 51, that is, total leak current $I_2$, can be detected by providing a resistor Ri2 in a grounded line 77 connected to the end plate 45. The total leak current $I_2$ is supplied to the control panel 14 through the LV cable.

With reference to FIG. 4, the total current $I_1$ flowing through a resistor Ri1 includes all currents flowing through the circuit of the atomizer 6. The total current $I_1$ is the sum of a current $I_3$ not contributing to the coating and a high-voltage current $I_4$ contributing to the coating. In other words, the high-voltage current $I_4$ contributing to the coating is equal to a result of subtraction of the bleed current $I_3$ not contributing to the coating from the total current $I_1$. That is, the current $I_4$ is given by the following equation (1):

$$I_4=I_1-I_3 \quad (1)$$

A current $I_5$ flowing through a grounded work W (hereafter called a work current $I_5$) is equal to a result of subtraction of the total leak current $I_2$ occurring inside the atomizer 6 from the high-voltage current $I_4$ contributing to the coating. That is, the current $I_5$ is given by the following equation (2):

$$I_5=I_4-I_2 \quad (2)$$

The work current $I_5$, which is the target of control, is given by the following expression (3) on the basis of the above equations (1) and (2):

$$I_5=I_1-I_2-I_3 \quad (3)$$

The bleed current $I_3$ in the expression (3) can be determined by dividing the high voltage output $V_m$ from the high voltage generator 20 by a resistance Rbr ($I_3=V_m/Rbr$).

Therefore, the work current $I_5$ to be controlled is given by the following equation (4):

$$I_5=I_1-I_2-V_m/Rbr \quad (4)$$

In the electrostatic coating system according to the first embodiment of the present invention, the control panel 14 does double controls of the high voltage from two different aspects. The first high voltage control is such that the work current $I_5$ is controlled in a substantially automatic manner. An example of this control is shown in the flowchart in FIG. 5. The second mode of high voltage control is such that the leak current $I_2$ is controlled in a substantially automatic manner, of which an example is specifically shown in the flowchart in FIG. 6.

Figure 5:
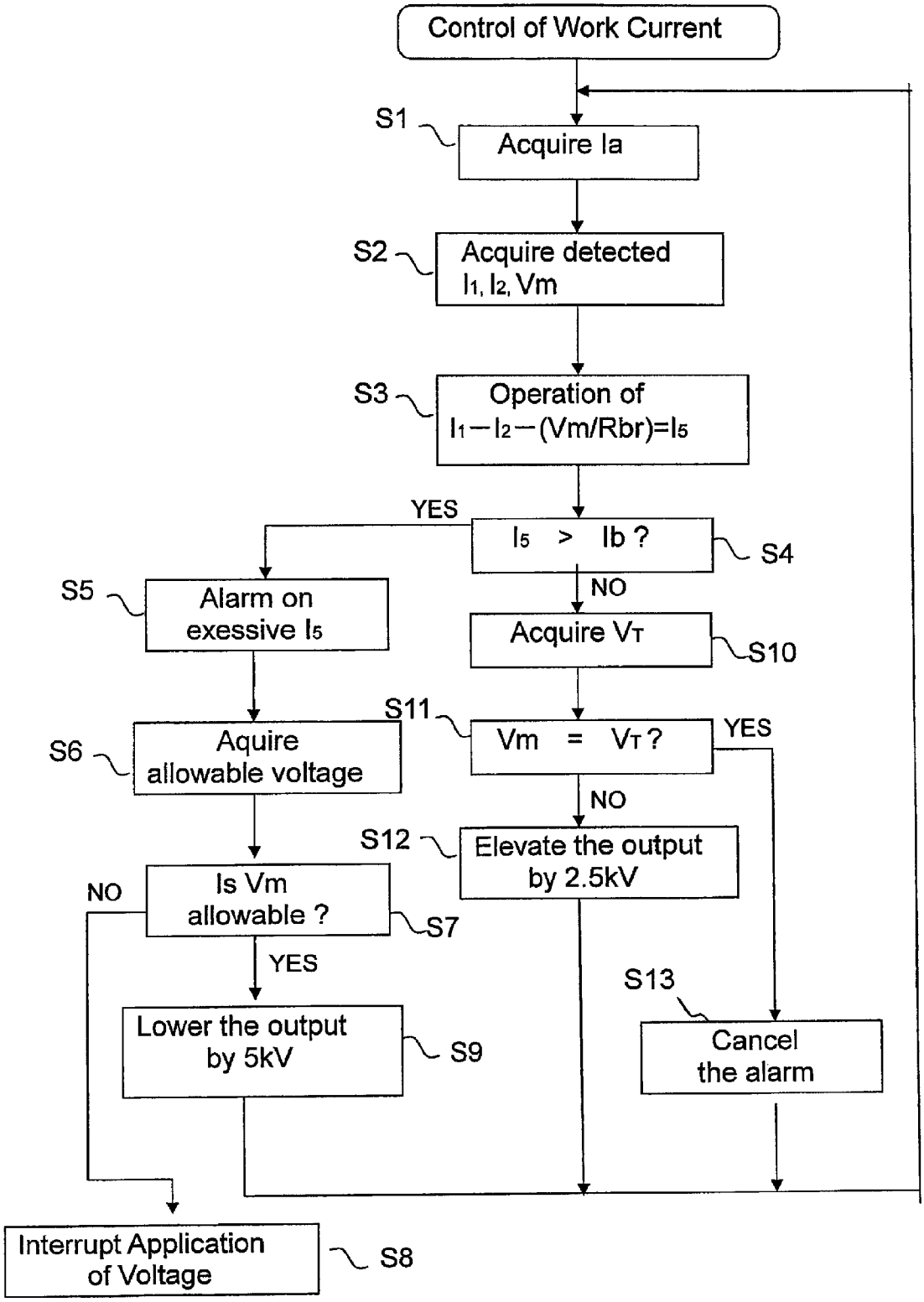
FIG. 5 is a flowchart of an exemplary high voltage control.

The example of the first mode of high voltage control is explained below with reference to the flowchart of FIG. 5. In step S1 of the flow, a first threshold Ia is acquired. In the next step S2, a total current $I_1$, total leak current $I_2$ and output high voltage value $V_m$ are acquired.

In the next step S3, the control panel 14 determines a current $I_5$ flowing through the leak current to be coated by calculating $I_1$, $I_2$ and $V_m$ acquired in step S2 on the basis of the expression (4) to. In step S4, the current $I_5$ is compared with the first threshold Ia. When the result of the comparison in step S4 shows that the current $I_5$ is larger than the first threshold Ia, it is assumed that an excessively large discharge has occurred between the atomizer 6 and the work W, and goes to step S5 in which an alarm is issued to the coating operator by an alarm lamp or the like (not shown). In the next step S6, an allowable range of high voltage (typically in %) is acquired from registration in the control panel 14. Then the flow goes to step S7 in which it is determined whether the output high voltage value $V_m$ falls within the allowable range of high voltage. If the result of the determination made in step S7 is negative (NO), that is, in case the output high voltage value $V_m$ is below the allowable range of high voltage, the flow moves to step S8 to actuate a safety mechanism. That is, for example, application of a high voltage to the bell head 18 is interrupted by stopping the power supply to the high voltage generator 20. On the contrary, if the result of the determination made in step S7 is affirmative (YES), that is, in case the output high voltage value $V_m$ is within the allowable range of high voltage, the flow goes to step S9 to stepwise lower the output high voltage value $V_m$ by a predetermined value (every 5 kV, for example). Then, the flow goes back to step S1.

For example, if the result of the comparison made in step S4 is negative (NO), that is, in case the work current $I_5$ is smaller than the first threshold Ia, when the coating system completes the coating operation of one vehicle body and a next vehicle body has arrived at the coating robot 1, the flow jumps to step S10 to acquire a predetermined high voltage value VT specified by a command. Then, the flow goes to step S11 to determine whether the current high voltage value $V_m$ is approximately equal to the predetermined high voltage value VT. If the result of the determination made in step S11 is negative (NO), it is assumed that the current output high voltage value $V_m$ is not substantially equal to the high voltage value VT, and the flow goes to step S12 to stepwise elevate the output high voltage value $V_m$ by a predetermined value (every 2.5 kV, for example). On the contrary, when the result of the determination made in step S11 is affirmative (YES), it is assumed that the present output high voltage value $V_m$ is approximately equal to the high voltage value VT, and the flow goes to step S13 to cancel the alarm.

As heretofore explained with reference to the flowchart in FIG. 5, when an excessively large work current $I_5$ flows through a work W because of, for example, excessive approach of the bell head 18 to the work W, the safety mechanism is activated to interrupt operation of the high voltage generator 20 and forcibly interrupt application of the high voltage value $V_m$ to the bell head 18. In contrast, when the work current $I_5$ is within the allowable range, the output high voltage value $V_m$ is lowered step by step by the predetermined value (as in step S9) to optimize the high voltage to be applied to the bell head 18 until the work current $I_5$ reaches a level not inviting troubles. Thus, it is possible to continue the coating operation under a lowered level of the work current $I_5$ without inviting accidents or problems.

Figure 6:
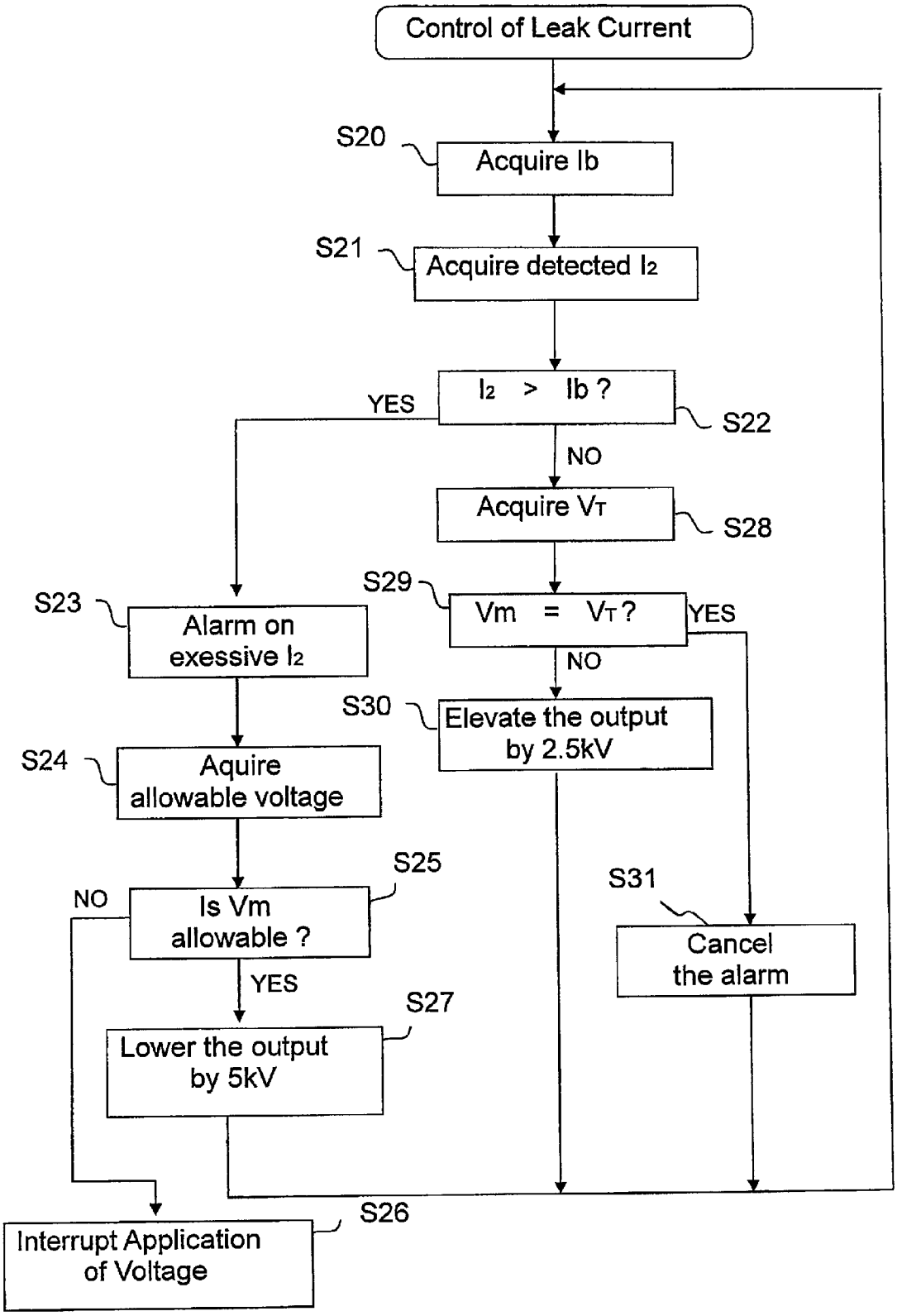
FIG. 6 is a flowchart of another exemplary high voltage control.

The example of the second mode of high voltage control will be explained below with reference to the flowchart of FIG. 6. In the first step S20, a second threshold Ib is acquired.

In the next step S21, a total leak current $I_2$ is acquired. In the next step S22, the total leak current $I_2$ acquired in step S21 is compared with the second threshold Ib. When the result of the comparison made in step S22 shows that the current $I_2$ is larger than the second threshold Ib, it is assumed that an excessively large leak current has occurred in the atomizer 6, and the flow goes to step S23 to issue an alarm to the coating operator by an alarm lamp or the like (not shown). In the next step S24, an allowable range of high voltage (typically in %) is acquired from registration in the control panel 14. Then, the flow goes to step S25 to determine whether the output high voltage value $V_m$ is within the allowable range of high voltage.

If the result of the determination made in step S25 is negative (NO), that is, in case the high voltage leak in the atomizer 6 is large and the output high voltage value $V_m$ is below the allowable range, the flow moves to step S26 to activate the safety mechanism. Accordingly, power supply to the high voltage generator 20 is interrupted to interrupt application of a high voltage to the bell head 18. In contrast, if the result of the determination made in step S25 is affirmative (YES), that is, in case the output high voltage value $V_m$ is within the allowable range of high voltage, the flow goes to step S27 to stepwise lower the output high voltage value $V_m$ by a predetermined value (every 5 kV, for example). Then, the flow returns to step S20.

In case the result of the comparison made in step S22 is negative (NO), that is, in case the total leak current $I_2$ is smaller than the second threshold Ib at the time when a next vehicle body arrives at the coating booth after the system completed coating of one vehicle body, the flow goes to step S28 to acquire a designated high voltage value VT. Then, the flow goes to step S29 to determine whether the current output high voltage value $V_m$ is approximately equal to the designated high voltage value VT. If the result of the determination made in step S29 is negative (NO), it is assumed that the current output high voltage value $V_m$ is apart from the designated high voltage value VT, and the flow goes to step S30 to stepwise elevate the output high voltage Value $V_m$ by a predetermined value (every 2.5 kV, for example). In contrast, if the result of the determination made in step S29 is affirmative (YES), it is assumed that the current output high voltage value $V_m$ is approximately equal to the designated high voltage value VT, and the flow moves to step S31 to cancel the alarm.

In the control explained above with reference to the flowchart in FIG. 6, application of the high voltage value $V_m$ to the bell head 18 is interrupted when an excessively large total leak current $I_2$ has been detected to flow in the atomizer 6. In the control shown in FIG. 6, however, if the total leak current $I_2$ is not so larger it is possible to stepwise lower the output high voltage value $V_m$ by a predetermined value (as in step S27) to optimize the high voltage applied to the bell head 18 such that the total leak current $I_2$ is maintained within a level not inviting accidents or problems. In this manner, the system can continue the coating operation while keeping the total leak current within a level not leading to accidents or serious problems.

The total leak current $I_2$ includes leak currents extracted via the wires 53 from the couplings 51 independently associated with all or some of individual passages and tubes inside the atomizer 6, such as the thinner supply tube for supplying the push-out thinner, pilot air tube 39 and suction tube 40, as well as a leak current caused by a deposit of paint on the outer surface of the atomizer 6, which is detected via the metallic connector 50 fixed to the metallic end plate 45 in electrical conduction therewith. More specifically, when the outer surface of the atomizer 6 is contaminated with a deposition of paint, for example, a leak current flows to the end plate 45 through the deposition of paint on the outer surface. The leak current can be detected via the metallic connector 50 and a wire 53 connected to the metallic connector 50. Such a high voltage leak outside the atomizer 6 can be taken as a factor for control as well in one or more of the high voltage control schemes explained above. Since the connector 50 for the cable sheathed with an electrically insulative material and used for electrical connection is used to detect a leak current on the outer surface of the atomizer 6, the leak current detected via the connector 50 has the advantage of being unliable to be influenced by any leak current inside the atomizer 6.

Similarly, leakage of a high voltage in internal elements of the atomizer 6 such as the passages or tubes 34, 37, 39, 40, or the like, which are related to the removable paint cartridge 16, can be detected via the wires 53 individually connected to the respective couplings 51 fixed to the end plate 45 via the electrically insulative elements 52 interposed between them. Therefore, a very position where the outstanding leakage has occurred can be readily located by individually inputting the high voltage leak detected via each wire 53 to CPU in the control panel 14. Located internal elements or positions having caused the high voltage leak can be displayed on a display 80 connected to the control panel 14 as shown in FIG. 4.

Similarly, high voltage leak through a deposition of paint on outer surfaces of the atomizer 6 can be detected via the metallic end plate 45 and the metallic connector 50 in direct connection to the end plate 45. Therefore, it is easy to know that outstanding high voltage leak has occurred on outer surfaces of the atomizer 6 by inputting the high voltage leak detected through the wire 53 connected to the metallic connector 50 to CPU in the control panel 14. Additionally, the fact that the outstanding high voltage leak has occurred on outer surfaces of the atomizer can be visually notified by using the display 80. In case the atomizer 6 has characteristics that there is a time-lag between a rise of the current value of a leak current and the time of an increase of deposition of paint, as shown in FIG. 2 of Japanese Patent Laid-open Publication No. JP H10-109054, that is, in case the deposition of paint on outer surfaces of the atomizer begins increasing later than the current value of a leak current start rising, it may be preferable that an intermediate value between a first current value taken before the increase of the deposition and a second leak current value taken after the increase of the deposition is preset as a threshold to give an alarm when a detected value surpass the threshold.

Also, in case the site of an outstanding high voltage leak is a position or element having a relatively low risk of fire, in other words, if high voltage leak has occurred in a location or element (such as an internal air path) inviting almost no problems even though the system is continuously driven, the leakage may be coped with by lower the sensitivity to high voltage leak to lower or elevate the above-mentioned voltage, namely, the voltage explained with reference to the flowchart of FIG. 5. More particularly, the system may execute a control to lower or elevate the above-mentioned voltage by comparing a result of subtraction of a leak current through the internal air passage, for example, from the total leak current $I_2$ with the thresholds (Ia and Ib). Alternatively, the system may execute a control to lower or elevate the above-mentioned voltage by comparing a result of subtraction of a leak current value in an internal air passage, weighted by a predetermined value (smaller than 1) from the total leak current $I_2$ with the thresholds (Ia and Ib). Otherwise, some different values may be set as these thresholds Ia and Ib may be set to selectively use thresholds of relatively high values among those thresholds Ia and Ib for the above-mentioned voltage control handling high voltage leak in a location or element inviting almost no problems even though the coating system is driven continuously.

It is also possible to lower the sensitivity for control by the safety mechanism to interruption of power by neglecting outstanding high voltage leak or weighting it by a predetermined value, depending upon whether or not the outstanding leak has occurred in a location or element having a relatively small risk of inviting fire.

Figure 7:
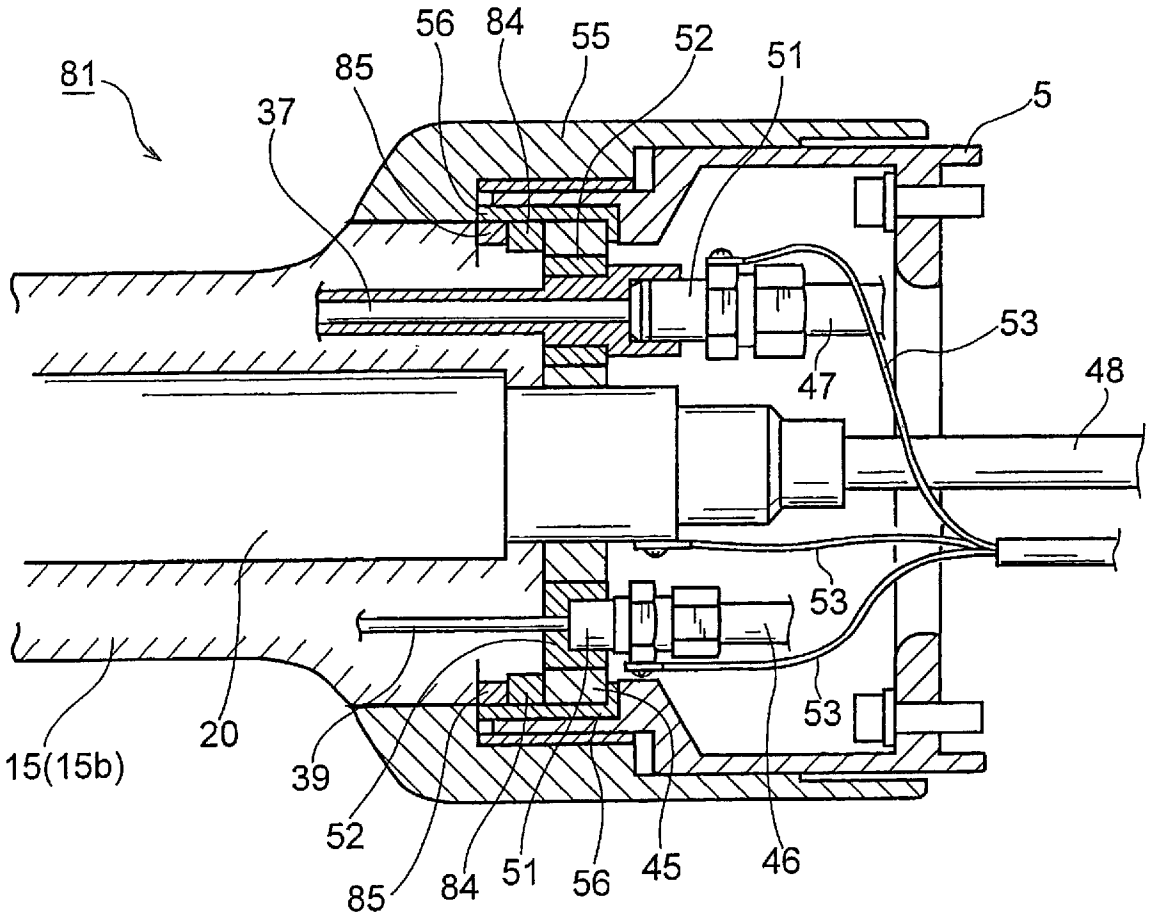
FIG. 7 is a cross-sectional enlarged view of a major part of an electrostatic coating system according to the second embodiment.

FIG. 7 shows a part of an electrostatic coating system as a second embodiment of the present invention. The second embodiment uses a coating robot 81 modified from the coating robot 1 used in the system according to the first embodiment already explained with reference to FIG. 2. The coating robot 81 is different from the coating robot 1 shown in FIG. 2 solely in configuration of its wrist portion 5 and the connection with the atomizer 6. In the other respects, the coating robot 81 used here (FIG. 7) is identical to the coating robot 1 used in the first embodiment (FIG. 2). Therefore, the coating robot 81 used here is explained below only about its features different from the coating robot 1 of the first embodiment, and explanation of its common or equivalent features is omitted here by simply showing them in FIG. 7 and denoting them with reference numerals common to those used in FIG. 2.

With reference to FIG. 7, in the coating robot 81 including the atomizer according to the second embodiment, the distal end of the wrist portion 5 made of stainless steel is located nearer to the bell head 18 than the end plate 45 of the atomizer 6. Accordingly, first and second two circular extension rings 84 and 85 made of stainless steel and electrically conductive are additionally provided on an outer margin or circumferential portion of the end plate 45. Thus, the outer margin or circumferential portion of the end plate 45 is extended toward the bell head 18 beyond the distal end of the wrist portion 5. That is, the first and second conductive extension rings 84 and 85 act as conductive extension members for extending the outer margin of the end plate 45 toward the bell head 18.

By extending the marginal portion or outer circumferential portion of the end plate 45 with the use of the first and second conductive rings 84 and 85 toward the bell head 18 beyond the distal end of the wrist portion 5, if any high voltage leak occurs caused by a deposition of paint on outer surfaces of the atomizer 6, it is possible to lead the high voltage leak to the end plate 45 via the first and second conductive rings 84 and 85. Additionally, the leak led to the end plate 45 can be detected through the metallic connector 50 fixed to the conductive end plate 45 in direct electrical conduction and the wire 53 connected to the connector 50.

Figure 8:
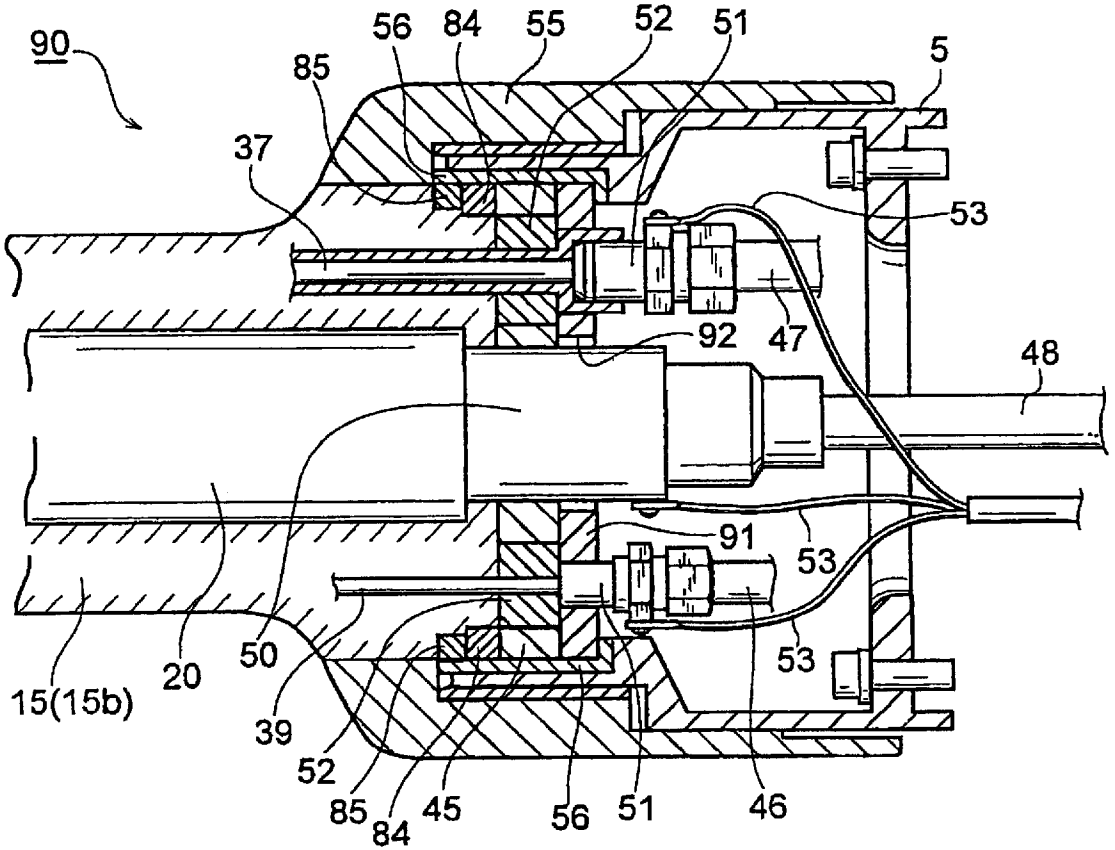
FIG. 8 is a cross-sectional enlarged view of a major part of an electrostatic coating system according to the third embodiment.

FIG. 8 shows a part of an electrostatic coating system as a third embodiment of the present invention. The third embodiment uses a coating robot 90 modified from the coating robot 1 used in the system according to the first embodiment (FIG. 2) and from the coating robot 81 used in the system according to the second embodiment (FIG. 7).

Apparently from comparison of FIG. 8 with FIG. 7, the coating robot 90 of FIG. 8 has a secondary plate 91 provided adjacent to and in abutment with the end plate 45. The secondary plate 91 is made of an insulative plastic material. Fixed to the secondary plate 91 are all couplings 51 except the electric connector 50. That is, all couplings 51 for liquid tubes and air tubes are fixed to the secondary plate 91. This embodiment is common to the first and second embodiments in that the connector 50 for the cable for powering the atomizer 6 is fixed to the end plate 45. Although FIG. 8 shows the secondary plate 91 as having a connector insertion hole 92 having a larger diameter than the outer diameter of the connector 50 in its center, the diameter of this connector insertion hole 92 may be equal to the outer diameter of the connector 50.

Some embodiments of the present invention have been explained as being intended for electrostatic coating by a rotary atomizer suitable for oil-borne paints. However, the system according to any of the embodiments is usable for spray-type electrostatic coating as well. Further, although the systems have been explained as using a removable paint cartridge, the invention is also applicable to electrostatic coating by paint supplied from a fixed type paint source without substantial changes. Further, although the embodiments have been explained as locating the high voltage generator 20 inside the electrostatic atomizer, the invention is also applicable to a system configured to supply the atomizer 6 with high voltage from an external high-voltage source without substantial changes. Furthermore, the invention is also applicable to electrostatic coating of the type using an external electrode and therefore suitable for use with an electrically conductive paint such as water-borne paint.

What is claimed is:

1. An electrostatic coating system including an electrostatic atomizer which has a high voltage application electrode provided at a distal end thereof to be supplied with a high voltage, and generates an electrostatic field between the high voltage application electrode and a work to electrically charge a paint and deposit the electrically charged paint onto the work due to electrical absorption, comprising:

an electrically conductive end plate disposed at a rear end of the electrostatic atomizer apart from the high voltage application electrode thereof, wherein high voltage leak caused by contamination of outer surfaces of the electrostatic atomizer is detected via the end plate, wherein the electrostatic atomizer is supplied with power via a conductive connector fixed to the end plate, and high voltage leak caused by contamination of outer surfaces of the electrostatic atomizer is detected through a first wire connected to the conductive connector, wherein the electrostatic coating system further comprises a coating robot, and the electrostatic atomizer is attached to a distal end of an arm of the coating robot, wherein the electrostatic coating system further comprises a paint cartridge removably attached to the electrostatic atomizer, and paint in the paint cartridge is discharged from the electrostatic atomizer, wherein a conductive ring is provided in contact with an outer marginal portion of the end plate to extend the end plate toward a distal end of the electrostatic atomizer.

2. The electrostatic coating system according to claim 1, further comprising a voltage control means for lowering the value of a high voltage supplied to the high voltage application electrode when high voltage leak by contamination of outer surfaces of the electrostatic atomizer has occurred.

3. The electrostatic coating system according to claim 1, wherein further wires are connected to couplings for tubes provided to supply fluids to the electrostatic atomizer, and a high voltage leak inside the electrostatic atomizer is detected via the further wires.

4. The electrostatic coating system according to claim 3, wherein said couplings are fixed to the end plate via an electrically insulating material.

5. The electrostatic coating system according to claim 1, wherein a secondary plate made of an electrically insulating material is provided adjacent to the end plate, and couplings for tubes for supplying fluids to the electrostatic atomizer are fixed to the secondary plate.

6. The electrostatic coating system according to claim 5, wherein further wires are connected to the couplings for the tubes and a high voltage leak inside the electrostatic atomizer is detected via the wires.

7. The electrostatic coating system according to claim 5, wherein the connector couples with an electric power cable sheathed with an electrically insulative material.

8. The electrostatic coating system according to claim 1, wherein the conductive ring extends toward a bell head of the atomizer.

* * * * *